United States Patent [19]

Pipkorn

[11] Patent Number: 4,910,634

[45] Date of Patent: Mar. 20, 1990

[54] INTERLOCK SWITCH

[75] Inventor: Mark G. Pipkorn, Minneapolis, Minn.

[73] Assignee: NCR Corporation, Dayton, Ohio

[21] Appl. No.: 293,232

[22] Filed: Jan. 2, 1989

[51] Int. Cl.[4] ..... H01H 3/16

[52] U.S. Cl. ..... 361/147; 361/160; 335/179; 335/205; 307/112; 340/547; 200/50 A; 200/61.62

[58] Field of Search ..... 361/143, 147, 171, 179, 361/194, 343, 344, 191, 192, 193, 160, 166, 167, 170; 200/50 A, 61.62; 335/179, 205; 364/184; 340/547; 219/10, 55 C; 307/112, 116, 326

[56] References Cited

U.S. PATENT DOCUMENTS

| | | | |
|---|---|---|---|
| 3,742,162 | 6/1973 | Wasemann | 200/61.62 |
| 3,771,154 | 11/1973 | Takei | 340/528 |
| 3,967,164 | 6/1976 | Valle | 361/347 |
| 4,214,220 | 7/1980 | Queen | 335/153 |
| 4,284,864 | 8/1981 | Crow et al. | 200/153 |
| 4,438,430 | 3/1984 | Young et al. | 340/547 |
| 4,581,597 | 4/1986 | Walley | 335/179 |
| 4,716,495 | 12/1987 | Craker | 361/391 |

*Primary Examiner*—Derek S. Jennings
*Assistant Examiner*—David Osborn
*Attorney, Agent, or Firm*—Wilbert Hawk, Jr.; Stephen F. Jewett

[57] ABSTRACT

An interlock switch for the service door of a computer. The switch prevents power from being automatically resupplied to the computer if the door is opened while power has been interrupted, even if the door is subsequently closed. The interlock switch includes a magnetic reed switch, an electromagnet for closing the reed switch contacts when the power-on switch of the computer is actuated, and a permanent magnet which holds the reed switch contacts closed as long as the service door has not been opened. The reed switch and electromagnet are mounted on the frame of the cabinet of the computer. The permanent magnet is mounted on the edge of the service door adjacent the reed switch. The use of the switch in a security system is also disclosed.

15 Claims, 2 Drawing Sheets

INTERLOCK SWITCH

BACKGROUND OF THE INVENTION

The present invention relates to safety interlock switches and, more particulary, to a switch for preventing power from being applied to an electrical or electronic appliance (such as a computer) once a service door or panel has been opened.

Safety interlock switches for electrical appliances are well known. Typically, they are found in appliances that have high voltage components, such as residential or commercial appliances that require 220 volt power. The service or access door on such appliances will normally actuate the interlock switch. When the door is closed, the contacts of the interlock switch are likewise closed and power is supplied to the appliance. When the door is opened (such as for repairing the appliance), the contacts of the interlock switch are open and power to the appliance is automatically interrupted to prevent accidental electrical shock.

Computer systems have in the past used power contactors in their power control circuits. Power contactors are essentially latching relays which connect the computer (or other load) to the power source when a start switch is actuated and continue the connection until actuating power is interrupted. Once power is interrupted (whether deliberately by an "off" switch or unintentionally because of power failure), the contacts of the power contactor open and electrically disconnect the computer from the power source until the computer is restarted or "booted up" by an operator or service technician.

More recently, computers have been designed to automatically restart after a power failure, so that there is no "down time" due to the need for a service technician to restart the computer. However, there is a risk with such computers that the power has been interrupted because of maintenance, e.g., repair or replacement of hardware components. If power should be inadvertently resupplied before completing maintenance, the computer can be damaged.

It has been proposed to minimize the risk noted above by providing an interlock switch at the service door of the computer. However, the known interlock switches only provide protection when the service door is open. If the door is opened and then closed, but maintenance not completed, such an interlock switch will not protect the computer against damage if the power should be resupplied.

There has thus arisen the need for an interlock switch or other means which prevents power from being resupplied to a computer when the service door of the computer is open, and also when the service door has been opened and then closed (unless the computer is deliberately restarted).

SUMMARY OF THE INVENTION

There is provided, in accordance with the present invention, a switch responsive to the movement of a first structure (such as a computer service door) relative to a second adjacent structure (such as the cabinet of the computer). The switch includes two contacts which are moved from a first position to a second position in response to a magnetic field of a first predetermined level, and which are held in the second position by a magnetic field of a second (e.g., smaller) predetermined level. The switch further includes a first magnetic means (which is an electromagnet in the preferred embodiment) and a second magnetic means (which is a permanent magnet in the preferred embodiment). The first magnetic means (electromagnet) generates the magnetic field of the first predetermined level and the second magnetic means (permanent magnet) generates a magnetic field of the second predetermined level. The two contacts are located on one of the first and second structures, and the second magnetic means is located on the other of the first and second structures.

In the described embodiments, the switch is used as a safety interlock switch for the service door of a computer. The two contacts are part of a magnetic reed switch mounted on the frame of the computer cabinet and the first magnetic means is an electromagnet mounted adjacent the reed switch on the frame. The second magnetic means is a permanent magnet mounted on the door of the computer. When power is first supplied to the computer, the electromagnet is energized and the resulting magnetic field is sufficiently large to cause the contacts of the reed switch to close, thereby connecting the computer to a power source. The permanent magnet on the door of the computer provides a magnetic field of a smaller level but sufficient (as long as the door remains closed) to hold the contacts of the reed switch in the closed position when the electromagnet ceases to be energized. If the service door should ever be opened when the electromagnet is no longer energized, the permanent magnet moves away from the reed switch and its contacts open, preventing power from being inadvertently supplied to the computer. This is the case even if the door should subsequently be closed, since the magnetic field of the permanent magnet is not sufficient by itself to close the contacts of the reed switch. The contacts remain open until the electromagnet is again energized.

It is therefore an object of the present invention to provide a new and improved switch for sensing the movement of one structure relative to an adjacent structure.

It is another object of the present invention to provide such a switch as a safety interlock switch.

It is yet another object of the present invention to provide such a switch for the service door of a computer cabinet.

It is still a further object of the present invention to provide a safety interlock switch for the service door of a computer which detects the opening of the door, even if the door should subsequently be closed.

These and other objects, features, and advantages of the present invention will become apparent from the following description and the attached drawings, wherein like reference numbers indicate like parts.

DETAILED DESCRIPTION OF THE PREFERRED EMBODIMENTS

Figure 1:
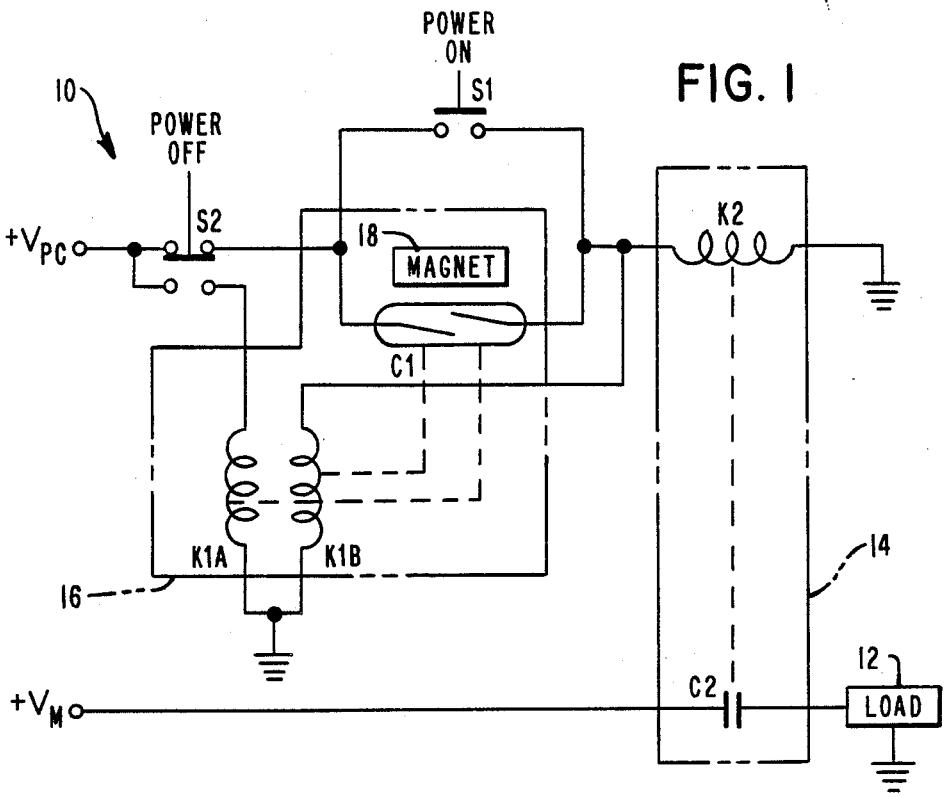
FIG. 1 is a circuit diagram illustrating a safety interlock switch in the electrical power circuit of a computer in accordance with the present invention.

Referring now to FIG. 1, there is seen the power circuit 10 of a computer. The power circuit 10 connects the primary electrical circuits or electrical load 12 of the computer to a main voltage source or supply $V_M$. The power circuit 10 is connected to a power circuit voltage source or supply $V_{PC}$. When a power-on switch S1 is actuated or depressed to close the normally open contacts of S1, current flows from the supply $V_{PC}$, though the normally closed contacts of a power-off switch S2 and the closed contacts of switch S1, to the coil K2 of a power contactor or relay 14 to ground. The switch contacts C2 of the power relay 14 then close, connecting the load 12 to the man voltage supply $V_M$. The operation of the power circuit 10 as thus far described is conventional.

In accordance with the present invention, the power circuit 10 includes an interlock switch 16. The switch 16 is located at the service door of the computer (which will be more fully described later in connection with FIG. 2) and detects movement of the door relative to the computer cabinet frame. The switch 16 includes a pair of oppositely wound coils K1A and K1B, a magnetic reed switch C1, and a permanent magnet 18.

Figure 2:
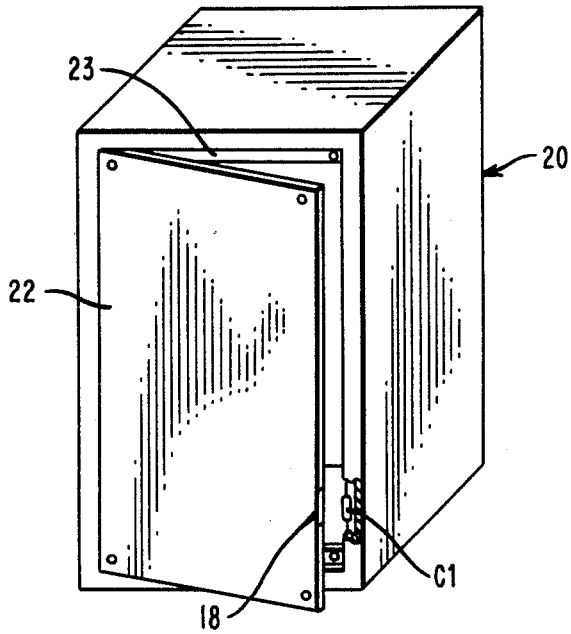
FIG. 2 is a perspective view of a computer cabinet, with the service door of the computer ajar and with a portion of the cabinet frame broken away, illustrating the location of the interlock switch of the present invention.

The operation of the interlock switch 16 will be described with reference to FIG. and with reference to FIG. 2, which shows the cabinet 20 of a computer in which the interlock switch is used. In FIG. 2, the cabinet 20 includes a rear access panel or service door 22 which is secured to the frame 23 of the cabinet by screws or the like (not shown). The permanent magnet 18 is mounted on the edge of the door 22, adjacent to the frame 23 where the reed switch C1 is mounted.

When the power-on switch S1 is depressed, current flows from $V_{PC}$ through the closed contacts of switches S2 and S1 to the coil K1B and ground, with the resulting magnetic field generated by coil K1B causing the contacts of the reed switch C1 close. The magnetic field of the permanent magnet, even though not sufficient by itself to close the contacts of the reed switch, is sufficient to hold the contacts in the closed position. With current flowing through the reed switch C1, the coils K1B and K2 remain energized (even after the power-on switch S1 ceases to be depressed) and the switch contacts C2 keep the load 12 connected to the main power supply $V_M$.

When the power-off switch S2 is depressed, current flow through reed switch C1 and coil K2 is interrupted, causing switch contacts C2 to open and the main power supply $V_M$ to be disconnected from the load 12. Depressing switch S2 also causes coil KAA to be energized, moving reed switch C1 back to the open position.

If $V_{PC}$ is interrupted, coil K2 will be deenergized and switch contacts C2 will open. Reed switch C1 will remain closed due to the magnetic field of the permanent magnet, however, and when $V_{PC}$ is restored, coil K2 will be re-energized. If the door 22 should be opened while VPC is interrupted, then the magnet 18 moves away from the reed switch C1 and the contacts of the reed switch open. When $V_{PC}$ is then reapplied, the coil K2 will no longer be energized (unless the power-on switch S1 is purposely depressed) and the load 12 will remain disconnected at the switch contacts C2 from the main power supply $V_M$.

If the door 22 should subsequently be closed, the reed switch C1 remains open, since the magnet 18 is not capable, by itself, of closing the contacts of the reed switch.

It should be appreciated that the interlock switch 16 is particularly advantageous when used in the power circuit of a computer, such as the power circuit 10 of FIG. 1. Often, during routine maintenance of the computer, the voltage supplies (such as $V_{PC}$ and $V_M$) will be disconnected and the rear service door opened. If components or boards are removed, and the service door closed, the computer could be damaged if the power supplies are prematurely reconnected. The interlock switch 16 prevents such an occurrence by opening the contacts of the reed switch C1 when the service door 22 is opened (even if subsequently closed), and keeping them open until the power-on switch S1 is depressed.

Figure 3:
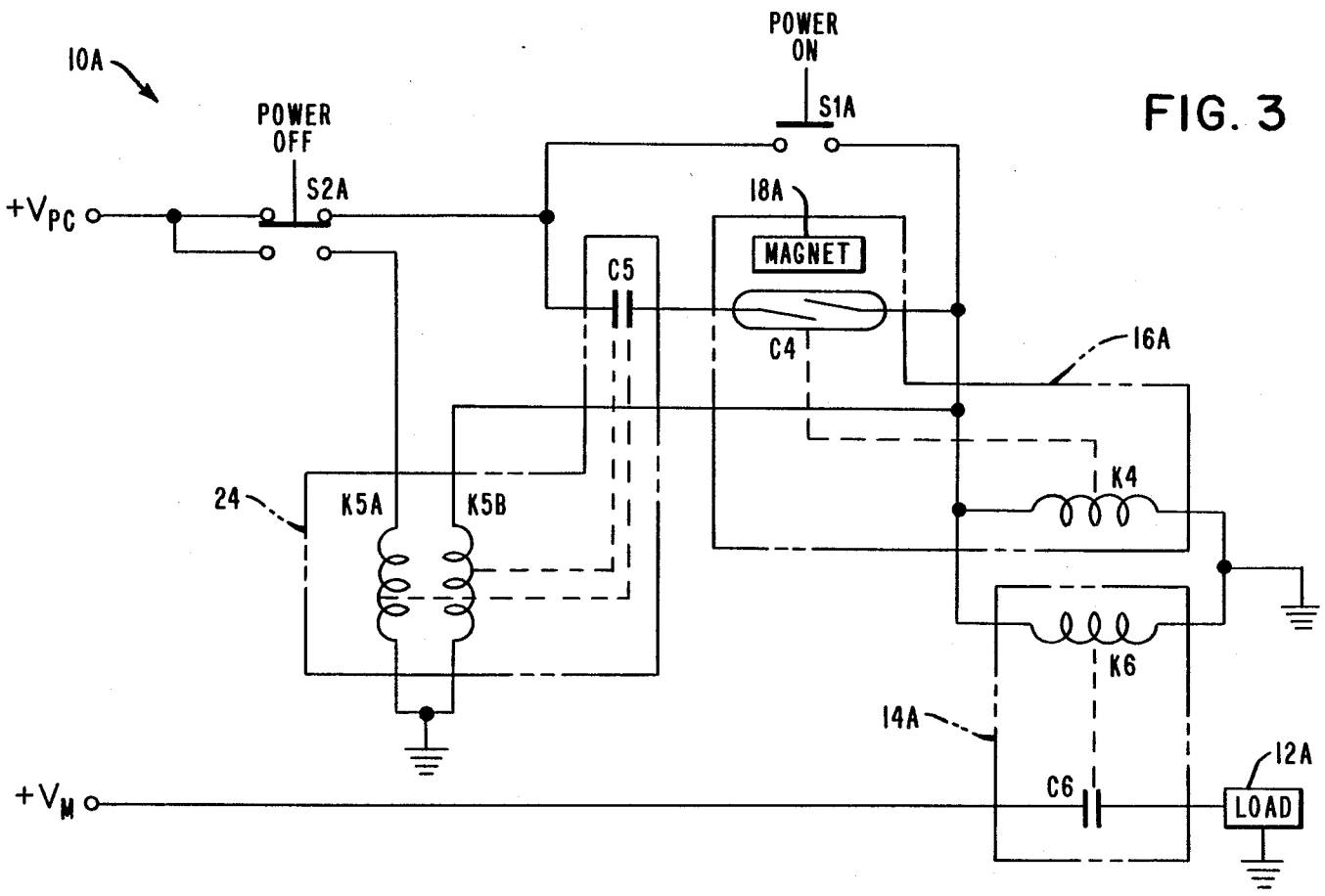
FIG. 3 is a circuit diagram similar to FIG. 1, illustrating an alternate embodiment of the present invention.

In FIG. 3 there is shown a power circuit 10A illustrating an alternate embodiment of the present invention. A magnetic reed switch C4 of an interlock switch 16A is controlled by a single coil K4 and a permanent magnet 18A. An additional latching relay 24 is used in the power circuit 10A, with the switch contacts C5 of the relay 24 controlled by oppositely wound coils K5A and K5B. A power contactor or relay 14A connects the main voltage supply $V_M$ to the load 12A.

In operation, when the power-on switch S1A is depressed, current flows from the power circuit voltage supply VPC through the coil K4, and the contacts of the reed switch C4 close. Current flowing from $V_{PC}$ through S2A, SA and K5B also cause the switch contacts C5 to likewise close. The resulting current (initially applied through S1A and maintained by the closed switch C4 and closed contacts 55) through the coil K6 of the power relay 14A causes the switch contacts C6 of the power relay 14A to connect the load 12A to the voltage supply $V_M$.

The contacts of the reed switch C remain closed after the power-on switch S1A ceases to be depressed because of both the energized coil K4 and the permanent magnet 18A. If $V_{PC}$ is removed and the service door opened, the magnet 18A moves away from the reed switch and the reed switch contacts open and disconnect the coil K6 from the voltage supply $V_{PC}$.

When the computer is to be powered off, the power-off switch S2A is depressed, interrupting current through C4, C5, K4, K5B and K6, and causing current flow through the coil K5A and the resulting magnetic field to open the switch contacts C5.

It can thus be seen that there has been provided by the present invention an interlock switch for a computer that prevents power from being supplied to the computer if the service door has been opened while power was off, even if the door should be subsequently closed. However, it should be appreciated that other uses of a switch in accordance with he present invention are possible. For example, the switch of the present invention could be used in a security system, where each location to be protected (e.g., a door or window) has the switch mounted thereon, so that upon movement of the door or window the switch opens and remains open even if the door or window should subsequently be closed. A monitoring device might periodically poll each switch and if one of the switches is open, causes the security system to provide an appropriate signal.

Although the presently preferred embodiments of the invention have been described, it will be understood that various changes may be made within the scope of the appended claims.

What is claimed is:

1. An interlock switch for operatively connecting a power source to an electrical load, comprising:

switch contacts having a first position and a second position, said contacts for being moved from said first position to said second position in response to a magnetic field;

first magnetic means for generating a first magnetic field when the power source is connected to the load, said first magnetic field causing said contacts to move from said first position to said second position; and second magnetic means having a first position and a second position and for generating a second magnetic field, said second magnetic field causing said contacts to be held in said second contact position when said second magnetic means is in said first position and being insufficient to hold said contacts in said second contact position when said second magnetic means is in said second position.

2. The switch of claim 1, wherein said contacts are open in the first position and are closed in the second position.

3. The switch of claim 2, wherein said contacts are the contacts of a magnetic reed switch.

4. The switch of claim 3, wherein said first magnetic means is an electromagnet, wherein said second magnetic means is a permanent magnet, and wherein said contacts and said electromagnet are supported on the frame of a computer and said permanent magnet is supported on the door of the computer.

5. The switch of claim 4 wherein, when said electromagnet is energized to move said contacts from said first position to said second position while the door is closed, said permanent magnet holds said contacts in said second position thereafter while the door remains closed, and wherein said contacts move from said second position to said first position when the door is opened and said permanent magnet moves away from the frame.

6. The switch of claim 4, wherein the switch is used to detect the opening of the service door of a computer, wherein said electromagnet is energized when electrical power is supplied to said computer, wherein said contacts remain closed after the power is first supplied to said computer by the magnetic field of the permanent magnet, and wherein said contacts open if the service door of the computer is opened, even if subsequently closed.

7. An interlock switch for the service door of an electrical appliance, said interlock switch disconnecting the appliance from an electrical energy source when the door is opened, said interlock switch comprising:

a magnetic switch having a first position where the appliance is connected through said magnetic switch to the energy source and a second position where the appliance is not connected through said magnetic switch to the energy source;

an electromagnet for generating a first magnetic field when electrically energized, the magnetic field causing said magnetic switch to move from said second switch position to said first switch position to thereby connect the appliance to the energy source;

a magnet supported in the appliance for generating a second magnetic field, the second magnetic field sufficient to hold the magnetic switch in the first switch position after it has been moved to the first switch position by the magnetic field of said electromagnet, and also supported in the appliance to move in relation to said magnetic switch when the service door is opened, so that when the magnetic switch has been moved to the first switch position by the first magnetic field, the second magnetic field of said magnet will hold the magnetic switch in the first switch position if said electromagnet ceases to be energized, but thereafter will not hold said magnetic switch in the first switch position if the service door is opened, thereby disconnecting the appliance from the electrical energy source.

8. A switch responsive to relative movement of a first structure and a second adjacent structure, said switch comprising:

two electrical contacts having a first position and a second position, said contacts being moved from said first position to said second position in response to a magnetic field of a first predetermined level and capable of being held in said second position by a magnetic field of a second predetermined level;

first magnetic means responsive to an electrical signal for generating a magnetic field of the first predetermined level and thereby causing said contacts to move from said first position to said second position; and second magnetic means for generating a magnetic field of the second predetermined level, said contacts located at one of said first and second structures, said second magnetic means located at the other of said first and second structures, so that upon relative movement of said first and second structures away from each other, said contacts go from a condition where the magnetic field of the second predetermined level from said second magnetic means is provided to said contacts and holds said contacts in said second position, to a condition where the magnetic field of the second predetermined level is not provided to said contacts and said contacts return to said first position.

9. The switch of claim 8, wherein said two contacts are open in the first position and are closed in the second position.

10. The switch of claim 9, wherein said two contacts are the contacts of a magnetic reed switch.

11. The switch of claim 10, wherein said first structure is a door or the like.

12. The switch of claim 11, wherein said adjacent structure is a frame at least partially surrounding said door.

13. The switch of claim 12, wherein said first magnetic means is an electromagnet, wherein said second magnetic means is a permanent magnet, and wherein said two contacts and said electromagnet are supported on said frame and said permanent magnet is supported on said door.

14. The switch of claim 13, wherein, when said electromagnet is energized to move said two contacts from said first position to said second position while said door is closed, said permanent magnet holds said contacts in said second position thereafter while said door remains closed, and wherein said contacts move from said second position to said first position when said door is opened and said permanent magnet moves away from said frame.

15. The switch of claim 13, wherein the switch is used to detect the opening of the service door of a computer, wherein said electromagnet is energized when electrical power is supplied to said computer, wherein said two contacts remain closed after the power is first supplied to said computer by the magnetic field of the permanent magnet, and wherein said two contacts open if the service door of said computer is opened, even if subsequently closed.

* * * * *